US012696932B2

(12) United States Patent
He et al.

(10) Patent No.: US 12,696,932 B2
(45) Date of Patent: Aug. 4, 2026

(54) ATOMIZATION CORE, ATOMIZER, AND ATOMIZATION DEVICE

(71) Applicant: SHENZHEN SMOORE TECHNOLOGY LIMITED, Shenzhen (CN)

(72) Inventors: Xueqin He, Shenzhen (CN); Congwen Xiao, Shenzhen (CN); Wu Chen, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 529 days.

(21) Appl. No.: 18/155,640

(22) Filed: Jan. 17, 2023

(65) Prior Publication Data

US 2023/0148668 A1 May 18, 2023

Related U.S. Application Data

(63) Continuation of application No. PCT/CN2020/105001, filed on Jul. 28, 2020.

(51) Int. Cl.

| | |
|---|---|
| ***A24F 40/46*** | (2020.01) |
| ***A24F 40/10*** | (2020.01) |
| ***A24F 40/42*** | (2020.01) |

(52) U.S. Cl.

CPC ..... *A24F 40/46* (2020.01); *A24F 40/10* (2020.01); *A24F 40/42* (2020.01)

(58) Field of Classification Search

CPC ..... A24F 40/46; A24F 40/10; A24F 40/42

See application file for complete search history.

(56) References Cited

U.S. PATENT DOCUMENTS

| | | | | |
|---|---|---|---|---|
| 2013/0333711 | A1* | 12/2013 | Liu | A24F 40/60 131/329 |
| 2014/0166029 | A1* | 6/2014 | Weigensberg | A24F 40/30 131/329 |
| 2015/0090279 | A1 | 4/2015 | Chen | |
| 2017/0265523 | A1* | 9/2017 | Lipowicz | H05B 3/26 |

(Continued)

FOREIGN PATENT DOCUMENTS

| | | | |
|---|---|---|---|
| CN | 105394816 | A | 3/2016 |
| CN | 205337599 | U | 6/2016 |

(Continued)

OTHER PUBLICATIONS

Chinese Patent Office, Office Action in Chinese Patent Application No. 202010735595.0 (Sep. 29, 2024).

(Continued)

*Primary Examiner* — Christopher M Rodd
*Assistant Examiner* — Jennifer A Kessie
(74) *Attorney, Agent, or Firm* — Leydig, Voit & Mayer, Ltd.

(57) ABSTRACT

A vaporization core of an electronic vaporization device includes: a heating body for generating heat; an electrode body electrically connected to the heating body; and a substrate for buffering liquid and having a mounting surface and a heating surface spaced apart from the mounting surface. The electrode body is arranged on the mounting surface. The heating body is arranged on the heating surface. The heating surface absorbs heat generated by the heating body and vaporize the liquid.

20 Claims, 5 Drawing Sheets

(56) References Cited

U.S. PATENT DOCUMENTS

| | | | | |
|---|---|---|---|---|
| 2019/0053539 | A1* | 2/2019 | Davis | A24F 40/46 |
| 2019/0246692 | A1 | 8/2019 | Li et al. | |

FOREIGN PATENT DOCUMENTS

| | | | |
|---|---|---|---|
| CN | 205492627 | U | 8/2016 |
| CN | 207285195 | U | 5/2018 |
| CN | 207383527 | U | 5/2018 |
| CN | 208274075 | U | 12/2018 |
| CN | 109259333 | A | 1/2019 |
| CN | 208318240 | U | 1/2019 |
| CN | 208624642 | U | 3/2019 |
| CN | 208724905 | U | 4/2019 |
| CN | 110037355 | A | 7/2019 |
| CN | 110074463 | A | 8/2019 |
| CN | 110179170 | A | 8/2019 |
| CN | 110313642 | A | 10/2019 |
| CN | 110498670 | A | 11/2019 |
| CN | 209643853 | U | 11/2019 |
| CN | 110584208 | A | 12/2019 |
| CN | 209732599 | U | 12/2019 |
| CN | 111000293 | A | 4/2020 |
| CN | 111109666 | A | 5/2020 |
| CN | 210642457 | U | 6/2020 |
| CN | 210782901 | U | 6/2020 |
| CN | 210929638 | U | 7/2020 |
| CN | 212545562 | U | 2/2021 |
| EP | 3884788 | A1 | 9/2021 |
| JP | 9148053 | A | 6/1997 |
| JP | 10321352 | A | 12/1998 |
| WO | 2017066955 | A1 | 4/2017 |
| WO | 2019035056 | A1 | 2/2019 |
| WO | 2019220372 | A1 | 11/2019 |

OTHER PUBLICATIONS

Patent Cooperation Treaty, International Search Report and Written Opinion, International Application No. PCT/CN2020/105001 (Apr. 29, 2021).

Japanese Patent Office, Notice of Reasons for Refusal in Japanese Patent Application No. 2023-504829 (Jan. 16, 2024).

European Patent Office, Search Report in European Patent Application No. 20947032.7 (Mar. 25, 2024).

European Patent Office, Office Action in European Patent Application No. 20947032.7 (Apr. 10, 2026).

* cited by examiner

ATOMIZATION CORE, ATOMIZER, AND ATOMIZATION DEVICE

CROSS-REFERENCE TO PRIOR APPLICATION

This application is a continuation of International Patent Application No. PCT/CN2020/105001, filed on Jul. 28, 2020. The entire disclosure is hereby incorporated by reference herein.

FIELD

The present invention relates to the technical field of vaporization, and in particular, to a vaporization core, a vaporizer, and an electronic vaporization device.

BACKGROUND

Dozens of carcinogens existing in the burning smoke of tobacco, such as tar, will do great harm to human health. Moreover, the smoke diffuses into the air to form second-hand smoke, which will also cause harm to people around you after inhaling the second-hand smoke. Therefore, smoking is forbidden in most public places. However, the electronic vaporization device has similar appearance and taste to ordinary cigarettes, but usually does not contain other harmful components such as tar and suspended particles in cigarettes. Therefore, the electronic vaporization device is widely used as a substitute for cigarettes.

The electronic vaporization device usually uses a vaporization core to vaporize liquid, thereby forming aerosol (smoke) for a user to inhale. The vaporization core is electrically connected to the power supply through a lead or an ejector pin. However, in order to ensure the stability and reliability of the connection between the lead or the ejector pin and the vaporization core, the total area of the entire heating surface may be compressed, resulting in the low utilization of the heating surface, which is not conducive to the layout of the heating body on the heating surface, and ultimately affects the vaporization effect of the entire vaporization core.

SUMMARY

In an embodiment, the present invention provides a vaporization core of an electronic vaporization device, comprising: a heating body configured to generate heat; an electrode body electrically connected to the heating body; and a substrate configured to buffer liquid and having a mounting surface and a heating surface spaced apart from the mounting surface, wherein the electrode body is arranged on the mounting surface, wherein the heating body is arranged on the heating surface, and wherein the heating surface is configured to absorb heat generated by the heating body and vaporize the liquid.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

In an embodiment, the present invention improves the vaporization effect of a vaporization core.

In an embodiment, the present invention provides a vaporization core of an electronic vaporization device, including:

- a heating body, configured to generate heat;
- an electrode body, electrically connected to the heating body; and
- a substrate, configured to buffer liquid and having a mounting surface and a heating surface spaced apart from the mounting surface, where the electrode body is arranged on the mounting surface, the heating body is arranged on the heating surface, and the heating surface is configured to absorb the heat generated by the heating body and vaporize the liquid.

A vaporizer is provided, including a suction nozzle and the vaporization core of any of the above. An airflow channel is formed in the suction nozzle. The vaporization core is located in the airflow channel. The airflow channel extends through a surface of the suction nozzle to form a suction nozzle opening for inhaling smoke. The heating surface is arranged facing the suction nozzle opening, and the mounting surface is arranged facing away from the suction nozzle opening.

An electronic vaporization device includes a power supply and the above vaporizer. The power supply includes a conductor configured to be electrically connected to the electrode body, and the conductor is located on a side where the mounting surface is located.

Details of one or more embodiments of the present invention are described in the following accompanying drawings and description. Other features, objects, and advantages of the present invention will be apparent from the specification, accompanying drawings, and claims.

In order to facilitate the understanding of the present invention, the present invention will be more fully described below with reference to the relevant accompanying drawings.

A preferred implementation of the present invention is shown in the accompanying drawings. However, the present invention may be implemented in many different forms and is not limited to the implementations described herein. On the contrary, these implementations are provided for a more thorough and comprehensive understanding of the disclosed content of the present invention.

It should be noted that when an element is considered to be "fixed" to an other element, the element may be directly on the other element or an intermediate element may exist. When an element is considered to be "connected" to an other element, the element may be directly connected to the other element or an intermediate element may exist. The terms "inside", "outside", "left", "right", and similar expressions used herein are for illustrative purposes only, and are not meant to be the only implementation.

Figure 1:
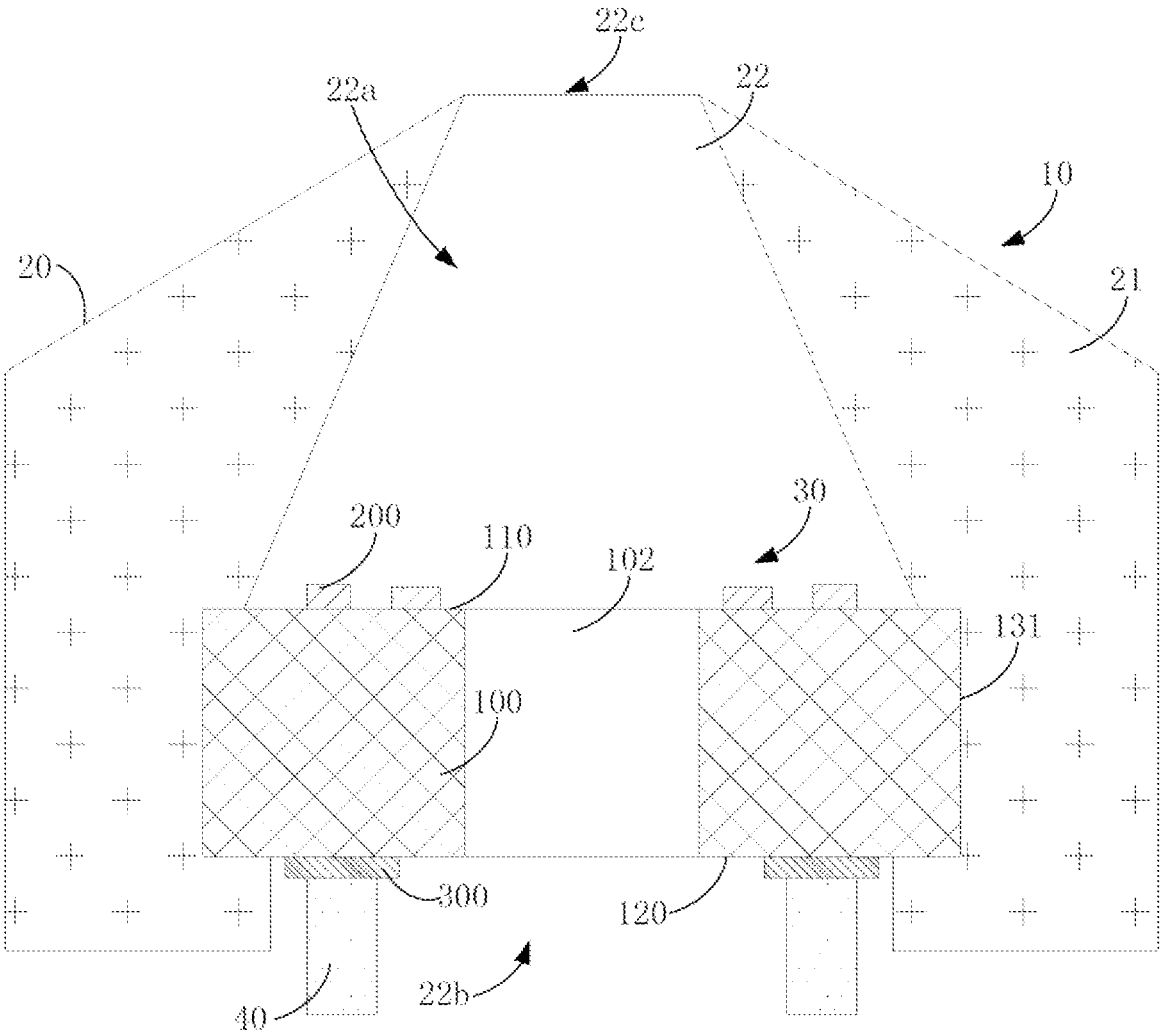
FIG. 1 is a schematic diagram of a cross-sectional structure of a vaporizer according to an embodiment.

Referring to FIG. 1, an electronic vaporization device provided in an embodiment of the present invention includes a vaporizer 10 and a power supply. The vaporizer 10 includes a suction nozzle 20 and a vaporization core 30. A liquid storage cavity 21 and an airflow channel 22 isolated from each other are formed in the suction nozzle 20, and the liquid storage cavity 21 is used for storing liquid. The vaporization core 30 is located in the airflow channel 22, and the vaporization core 30 absorbs and buffers the liquid in the liquid storage cavity 21, and vaporizes the liquid to form inhalable smoke. The smoke is essentially an aerosol. The airflow channel 22 extends through a surface (an upper end face) of the suction nozzle 20 to form a suction nozzle opening 22*c*. When the liquid is vaporized by the vaporization core 30 to form smoke discharged into the airflow channel 22, a user may contact the suction nozzle opening 22*c* to inhale the smoke in the airflow channel 22. The power supply includes a conductor 40. The conductor 40 may be a conductive pillar with a columnar structure. The conductor 40 is electrically connected to the vaporization core 30, so that the power supply supplies power to the entire vaporization core 30 through the conductor 40, and the vaporization core 30 converts electric energy to heat energy required for liquid vaporization.

Figure 2:
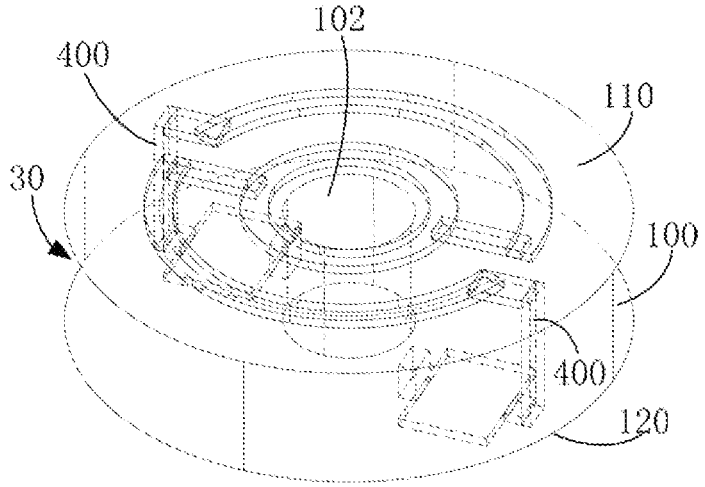
FIG. 2 is a schematic three-dimensional structural diagram of a first example vaporization core of the vaporizer shown in FIG. 1.
Figure 3:
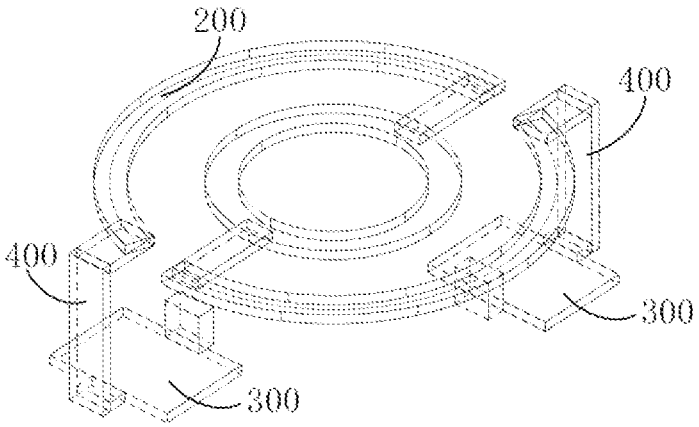
FIG. 3 is a partial schematic three-dimensional structural diagram of the vaporizer shown in FIG. 2 with a substrate being removed.
Figure 4:
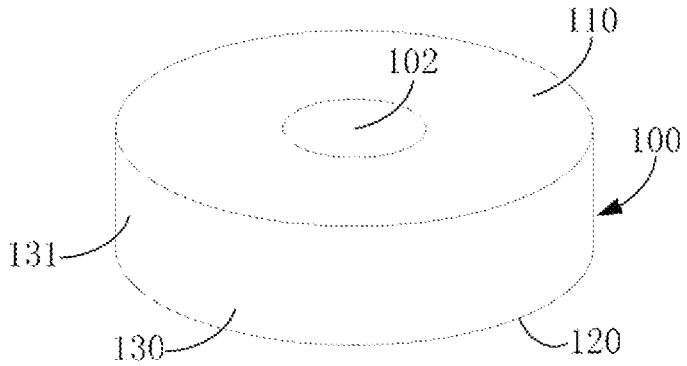
FIG. 4 is a schematic three-dimensional structural diagram of the substrate in the vaporizer shown in FIG. 2.

Referring to FIG. 2, FIG. 3, and FIG. 4 together, in some embodiments, the vaporization core 30 includes a substrate 100, a heating body 200, an electrode body 300, and a connecting body 400. The substrate may be made of porous glass, porous ceramics, honeycomb ceramics, and the like. In this embodiment, the substrate 100 is a porous ceramic body, that is, the substrate 100 is made of the porous ceramic material. For example, the substrate 100 may be made of aluminum oxide, silicon oxide, silicon nitride, silicate, silicon carbide, or the like, so that a large number of micro-pores exist in the substrate 100 to form a certain porosity. The porosity is defined as a ratio of the volume of pores in an object to the total volume of the material in the natural state. The porosity of the substrate 100 may range from 20% to 80%. For example, a specific value of the porosity may be 20%, 40%, 50%, or 80%. An average pore diameter of the micro-pores in the substrate 100 may range from 20 μm to 55 μm. For example, a specific value of the pore diameter is 20 μm, 30 μm, 45 μm, or 55 μm.

Figure 5:
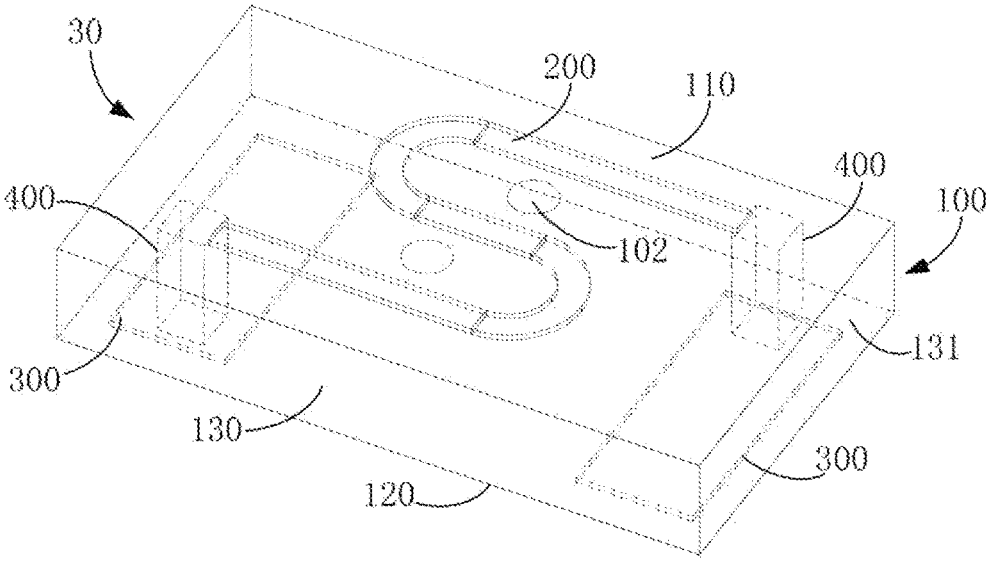
FIG. 5 is a schematic three-dimensional structural diagram of a second example vaporization core of the vaporizer shown in FIG. 1.
Figure 6:
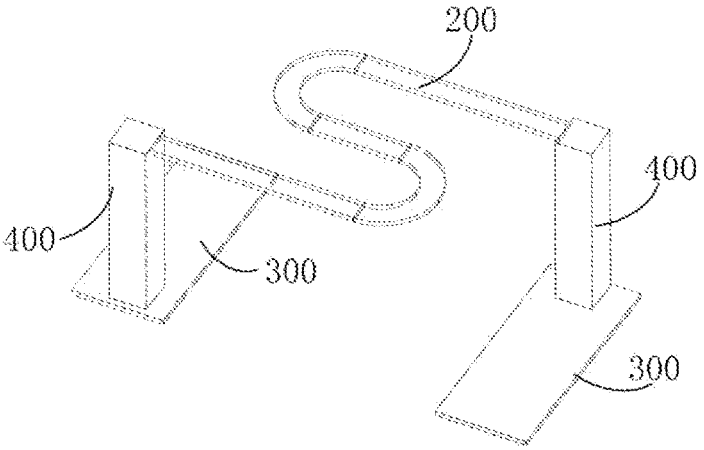
FIG. 6 is a partial schematic three-dimensional structural diagram of the vaporizer shown in FIG. 5 with a substrate being removed.
Figure 7:
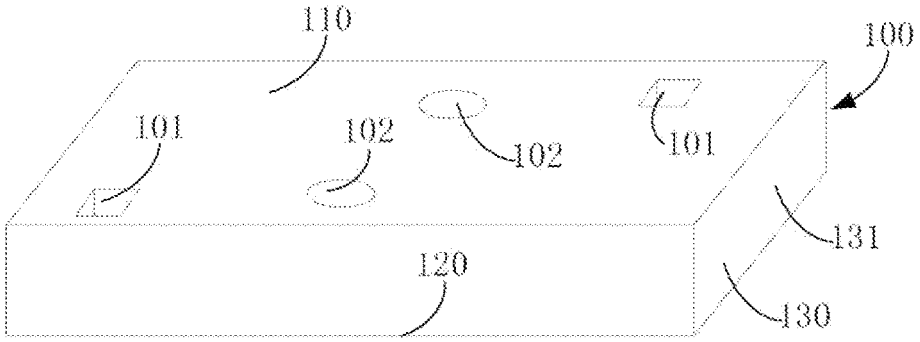
FIG. 7 is a schematic three-dimensional structural diagram of the substrate in the vaporizer shown in FIG. 5.

The substrate 100 may be formed by injection molding or powder pressing molding, and the shape of the substrate 100 may be a cylindrical shape or a prismatic shape. Referring to FIG. 5, FIG. 6, and FIG. 7 together, when the substrate 100 is prismatic, the substrate 100 may be cuboid.

When the substrate 100 contacts the liquid in the liquid storage cavity 21, the substrate 100 forms capillary action due to the existence of the micro-pores, and the liquid may gradually permeate into the substrate 100 through the capillary action, so that the substrate 100 has a certain buffering function for the liquid. The flow resistance of the liquid when permeating into the substrate 100 is inversely proportional to the porosity and the average pore size of the micro-pores. A larger porosity and a larger average pore size of the substrate 100 lead to a smaller flow resistance of the liquid in the substrate 100. In addition, the substrate 100 made of the porous ceramic material has good high temperature resistance, which prevents the liquid buffered in the substrate 100 from producing a chemical reaction with the substrate 100 at a high temperature, causing a waste of the liquid due to nonparticipation in an unnecessary chemical reaction, and avoiding various harmful substances produced by the chemical reaction.

Referring to FIG. 1, FIG. 2, and FIG. 5, in some embodiments, the substrate 100 has a heating surface 110 and a mounting surface 120. The heating surface 110 can absorb heat and heat up to vaporize the liquid, and the mounting surface 120 cannot vaporize the liquid. Therefore, the heating surface 110 and the mounting surface 120 are two different surfaces. The heating surface 110 and the mounting surface 120 are spaced apart in an extending direction (that is, a vertical direction) of the airflow channel 22, and the heating surface 110 and the mounting surface 120 are oriented in just opposite directions. In this case, the heating surface 110 is arranged facing the suction nozzle opening 22*c* and facing away from the power supply, that is, the heating surface 110 is arranged facing upward. The mounting surface 120 is arranged facing away from the suction nozzle opening 22*c* and facing the power supply, that is, the mounting surface 120 is arranged facing downward. Generally speaking, the heating surface 110 is an upper surface of the substrate 100, and the mounting surface 120 is a lower surface of the substrate 100. In other embodiments, for example, referring to FIG. 8, the heating surface 110 is still arranged facing upward, the mounting surface 120 is located below the heating surface 110, and the mounting surface 120 and the heating surface 110 are both arranged facing upward. Certainly, the mounting surface and the heating surface may be further both arranged facing downward.

The heating body 200 may be a metal heating body or an alloy heating body, that is, the heating body 200 may be made of a metal material or an alloy material. The alloy material may be selected from Fe—Cr alloy, Fe—Cr—Al alloy, Fe—Cr—Ni alloy, Cr—Ni alloy, titanium alloy, stainless steel alloy, Kama alloy, or the like. The heating body 200 may be formed through processes such as die stamping, casting, mechanical weaving, chemical etching, or screen printing. The substrate 100 and the heating body 200 may be integrally formed. For example, the substrate and the heating body are integrally formed by glue discharging and sintering. Certainly, the substrate 100 and the heating body 200 may also be formed separately. For example, the substrate 100 is formed first, and then the heating body 200 is connected to the substrate 100 through screen printing, glue discharging, and sintering.

The heating body 200 may be a strip-shaped sheet structure, and the heating body 200 may be bent to form various regular or irregular patterns. For example, the heating body 200 is S-shaped. The heating body 200 is arranged on the heating surface 110, for example, the heating body 200 is directly attached to the heating surface 110, so that the heating body 200 protrudes from the heating surface 110 by a certain height. For another example, a groove may be formed on the heating surface 110. The groove is formed by recessing a part of the heating surface 110 by a set depth, and the heating body 200 is embedded in a groove 111, so that an upper surface of the heating body 200 protrudes from the heating surface 110 by a certain height, or the upper surface of the heating body 200 is just flush with the heating surface 110. The thickness of the heating body 200 may range from 0.01 mm to 2.00 mm, for example, a specific value of the thickness may be 0.01 mm, 0.03 mm, 0.1 mm, 2.00 mm, or the like. The width of the heating body 200 ranges from 0.05 mm to 3 mm. For example, a specific value of the width may be 0.05 mm, 0.06 mm, 0.25 mm, 30 mm, or the like.

The electrode body 300 is electrically connected to the heating body 200, and the electrode body 300 is also electrically connected to the conductor 40. The power supply successively supplies power to the heating body 200 through the conductor 40 and the electrode body 300. The resistivity of the electrode body 300 is significantly less than the resistivity of the heating body 200, so that the electrode body 300 has excellent conductivity. The electrode body 300 may be a sheet structure. The electrode body 300 is arranged on the mounting surface 120. For example, the heating body 200 is directly attached to the heating surface 110, so that the heating body 200 protrudes from the heating surface 110 by a certain height. For another example, a groove may be formed on the mounting surface 120. The groove is formed by recessing a part of the mounting surface 120 by a set depth, and the electrode body 300 is embedded in a groove 111, so that an upper surface of the electrode body 300 protrudes from the mounting surface 120 by a certain height, or the upper surface of the electrode body 300 is just flush with the mounting surface 120. Two electrode bodies 300 are arranged. One electrode body 300 serves as a positive electrode and the other electrode body 300 serves as a negative electrode.

Since the heating body 200 is connected in series with the electrode body 300, the resistivity of the electrode body 300 is significantly less than the resistivity of the heating body 200. When the power supply supplies power to the heating body 200, the heating body 200 generates a large amount of heat, and the heating surface 110 absorbs the heat generated by the heating body 200 and heats up. The temperature is enough to vaporize the liquid. However, the heat generated by the electrode body 300 may be neglected, and therefore the mounting surface 120 cannot generate a high temperature that can vaporize the liquid.

If the heating body 200 and the electrode body 300 are both arranged on the heating surface 110, on the one hand, the electrode body 300 occupies part of an area of the heating surface 110, which leads to the reduction of the effective vaporization area on the heating surface 110, that is, the effective vaporization area is compressed, thereby reducing the vaporization amount of the liquid by the heating surface 110 per unit time and the concentration of smoke, and which also leads to a slower speed of generating smoke by the heating surface 110, thereby affecting the sensitivity of the vaporization core 30 to an inhalation response. On the other hand, the electrode body 300 and the conductive pillar can absorb the heat on the heating surface 110, which causes the connection failure between the electrode body 300 and the conductor 40 as a result of high temperature, thereby affecting the service life of the vaporization core 30, and which also causes a large amount of heat loss in the heating surface 110, thereby affecting the thermal efficiency of the heating surface 110.

In the above embodiment, the heating body 200 is arranged on the heating surface 110, and the electrode body 300 is arranged on the mounting surface 120, that is, the heating body 200 and the electrode body 300 are arranged on different surfaces of the substrate 100, so as to prevent the electrode body 300 and the heating body 200 from being both located on the same heating surface 110. In this way, the electrode body 300 can be prevented from occupying the part of the area of the heating surface 110, thereby ensuring that the heating surface 110 maintains the effective vaporization area sufficient to vaporize liquid, increasing the vaporization amount of liquid by the heating surface 110 per unit time, and increasing the concentration of smoke. The speed of generating smoke by the heating surface 110 is also increased, thereby improving the sensitivity of the vaporization core 30 to the inhalation response. In addition, the connection failure between the electrode body 300 and the conductive pillar due to the absorption of heat from the heating surface 110 may be further prevented, thereby prolonging the service life of the vaporization core 30 and reducing the heat loss of the heating surface 110 to improve the thermal efficiency of the heating surface 110.

Referring to FIG. 4 and FIG. 7, in some embodiments, the substrate 100 further includes a liquid absorbing surface 131. The liquid absorbing surface 131 is connected between the heating surface 110 and the mounting surface 120. When the heating surface 110 is an upper surface of the substrate 100 and the mounting surface 120 is a lower surface of the substrate 100, the liquid absorbing surface 131 is actually a part of a side surface 130 of the substrate 100. Referring to FIG. 1, the liquid absorbing surface 131 is configured to contact the liquid in the liquid storage cavity 21, and the liquid contacting the liquid absorbing surface 131 may permeate into the substrate 100 under capillary action.

Referring to FIG. 2, FIG. 3, and FIG. 4, the connecting body 400 is connected between the electrode body 300 and the heating body 200. Two connecting bodies 400 are arranged. An upper end of one of the connecting bodies 400 is electrically connected to one end of the heating body 200 and a lower end thereof is electrically connected to one of the electrode bodies 300, and an upper end of the other of the connecting bodies 400 is electrically connected to an other end of the heating body 200 and a lower end thereof is electrically connected to the other of the electrode bodies 300. The connecting body 400 may be made of the same material as the heating body 200, and the connecting body and the heating body may further be integrally formed. A through hole 101 is further formed on the substrate 100. The through hole 101 extends in an arrangement direction and extends through both the heating surface 110 and the mounting surface 120. The connecting body 400 is engaged with the mounting through hole 101, so that the entire connecting body 400 extends through the inside of the substrate 100.

Because the connecting body 400 extends through the inside of the substrate 100, on the one hand, the mounting stability of the connecting body 400 can be improved, and the heating body 200 can be firmly fixed to the heating surface 110. The connection strength between the connecting body 400 and the electrode body 300 can also be improved, so as to ensure the stability and reliability of both the connecting body 400 and the electrode body 300 in terms of mechanical connection and electrical connection. On the other hand, when the connecting body 400 is energized, the connecting body 400 generates a certain amount of heat, to preheat the substrate 100 to a certain extent. The viscosity of the liquid buffered in the substrate 100 decreases due to the absorption of heat, thereby improving the fluidity of the liquid inside the substrate 100, that is, reducing the flow resistance of the liquid. In this way, the liquid can quickly reach the heating surface 110 from the liquid absorbing surface 131 through the inside of the substrate 100 for vaporization, thereby avoiding the dry burning phenomenon, and ensuring that the entire vaporization core 30 can meet the vaporization requirement of the high viscosity liquid.

Further, the spacing between the connecting body 400 and the liquid absorbing surface 131 is less than the spacing between the connecting body 400 and the geometric center of the substrate 100. Generally speaking, the connecting body 400 is arranged closer to the liquid absorbing surface 131. In this case, the area of the substrate 100 close to the liquid absorbing surface 131 can quickly absorb heat to improve the fluidity of the liquid, so as to ensure that the liquid quickly enters the substrate 100 from the liquid storage cavity 21 through the liquid absorbing surface 131.

Figure 8:
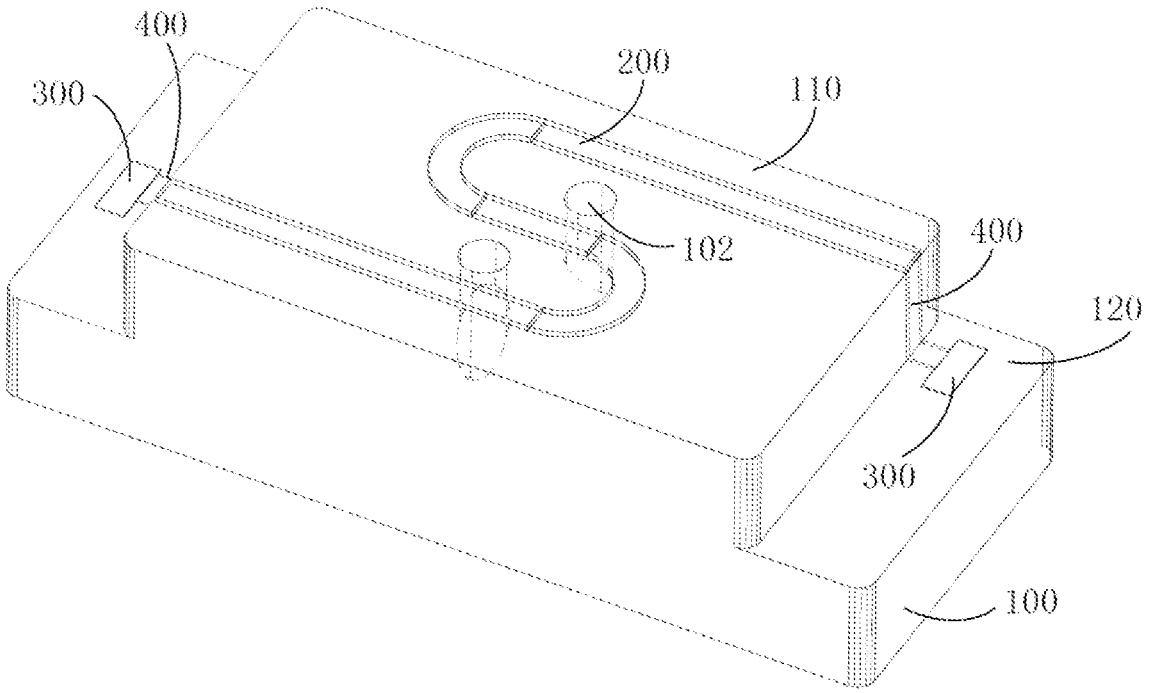
FIG. 8 is a schematic three-dimensional structural diagram of a third example vaporization core of the vaporizer shown in FIG. 1.

In other embodiments, the connecting body 400 and the heating body 200 may also be made of different materials respectively. As shown in FIG. 8, the connecting body 400 may be further directly attached to the outer surface of the substrate 100 without extending through the inside of the substrate 100.

Referring to FIG. 1, if the heating surface 110 is arranged facing away from the suction nozzle opening 22*c* toward the power supply, in this case, the entire vaporization core 30 partitions the airflow channel 22 into two parts. A part of the airflow channel 22 above the vaporization core 30 is denoted as an upper channel 22*a*, and a part of the airflow channel 22 below the vaporization core 30 is denoted as a lower channel 22*b*. In addition, the conductor 40 is also located in the lower channel 22*b*. When the heating body 200 is in operation, the smoke generated on the heating surface 110 will first enter the lower channel 22*b*, then pass through the part of the airflow channel 22 between the vaporization core 30 and the suction nozzle 20 and enter the upper channel 22*a*, and finally the smoke is absorbed by the user through the suction nozzle opening 22*c*. The design mode may be referred to as "a downward vaporization mode" for short.

The above "downward vaporization mode" has at least the following four defects. First, because the smoke is first discharged into the lower channel 22*b*, and the conductor 40 occupies part of the space in the lower channel 22*b*, the total space of the lower channel 22*b* is compressed and reduced, which is not conducive to the full vaporization of the liquid. Second, the smoke discharged into the lower channel 22*b* contacts the conductor 40, and the conductor 40 hinders the circulation and transmission of smoke, which affects the transmission speed of smoke in the airflow channel 22. Third, the smoke generated on the heating surface 110 passes through a long path and reaches the suction nozzle opening 22*c*, which increases the probability that the smoke will condense in the airflow channel 22 to form large-particle droplets, thereby reducing the concentration due to smoke loss, and also causing the large-particle droplets to block the airflow channel 22 or leak to the power supply to erode the power supply. If it is necessary to reduce smoke solidification, higher requirements are to be imposed on the structural design of the entire airflow channel 22, which may increase the design and manufacturing costs of the entire electronic vaporization device. Fourth, the liquid tends to gather on the heating surface 110 under the action of gravity. In a case that the viscosity of the liquid itself is low, the liquid gathered on the heating surface 110 drops from the vaporization core 30, thereby causing liquid leakage.

Referring to FIG. 1, in the above embodiment, the heating surface 110 is arranged facing the suction nozzle opening 22*c* (that is, arranged facing upward), and the mounting surface 120 is arranged facing away from the suction nozzle opening 22*c* and facing the power supply (that is, arranged facing downward), so that the conductor 40 is located on a side where the mounting surface 120 is located. That is to say, the conductor 40 is located in the lower channel 22*b*. When the heating body 200 is in operation, the smoke generated on the heating surface 110 directly enters the upper channel 22*a* instead of being discharged to the lower channel 22*b*. The design mode may be referred to as "an upward vaporization mode" for short. The above "upward vaporization mode" has at least the following four beneficial effects. First, smoke is directly discharged into the upper channel 22*a*, and the conductor 40 in the lower channel 22*b* does not occupy the space of the upper channel 22*a*, so that the space of the upper channel 22*a* is large enough to facilitate the full vaporization of liquid. Second, the smoke is directly discharged into the upper channel 22*a*, and the conductor 40 in the lower channel 22*b* does not contact the smoke in the upper channel 22*a*, thereby effectively avoiding the obstruction of the smoke by the conductor 40 and improving the circulation speed of the smoke in the airflow channel 22. Third, the smoke generated on the heating surface 110 directly reaches the suction nozzle opening 22*c* through the upper channel 22*a* to be absorbed by the user, thereby eliminating the flow path of smoke from the lower channel 22*b* to the upper channel 22*a*, and reducing the path length through which the smoke reaches the suction nozzle opening 22*c*, so that the probability that the smoke condenses in the airflow channel 22 to form large-particle droplets is reduced, which prevents the reduction of the concentration due to smoke loss, and also effectively prevents the large-particle droplets from blocking the airflow channel 22 or leaking to the power supply to erode the power supply. In addition, the requirements of the airflow channel 22 in structural design can be appropriately reduced, thereby reducing the design and manufacturing costs of the entire electronic vaporization device. Fourth, the liquid is aggregated against gravity upward to the heating surface 110, thereby reducing the possibility of liquid dropping from the vaporization core 30 and causing leakage.

Referring to FIG. 1 and FIG. 2, in some embodiments, an air guide hole 102 is further formed on the substrate 100. The air guide hole 102 extends through both the mounting surface 120 and the heating surface 110. When the user inhales at the suction nozzle opening 22*c*, gas may enter the upper channel 22*a* from the lower channel 22*b* through the air guide hole 102, so that the gas carries smoke to the suction nozzle opening 22*c*. The caliber of the air guide hole 102 ranges from 0.05 mm to 5.00 mm. For example, a specific value of the caliber of the air guide hole 102 may be 0.05 mm, 1 mm, 4 mm, 5 mm, or the like. One or more air guide holes 102 may be arranged. The air guide hole 102 may be a round hole, an elliptical hole, a regular polygonal hole, or the like. The mounting surface 120 and the heating surface 110 may be two planes parallel to each other. Certainly, the mounting surface 120 and the heating surface 110 may further be curved surfaces.

In some embodiments, a groove 111 is formed on the mounting surface 120. The groove 111 is recessed toward the heating surface 110 by a set depth. By arranging the groove 111, the total weight of the vaporization core 30 can be reduced, and the flow resistance of the liquid in the substrate 100 can be reduced, so that the liquid can quickly reach the heating surface 110 from the liquid absorbing surface 131.

Figure 9:
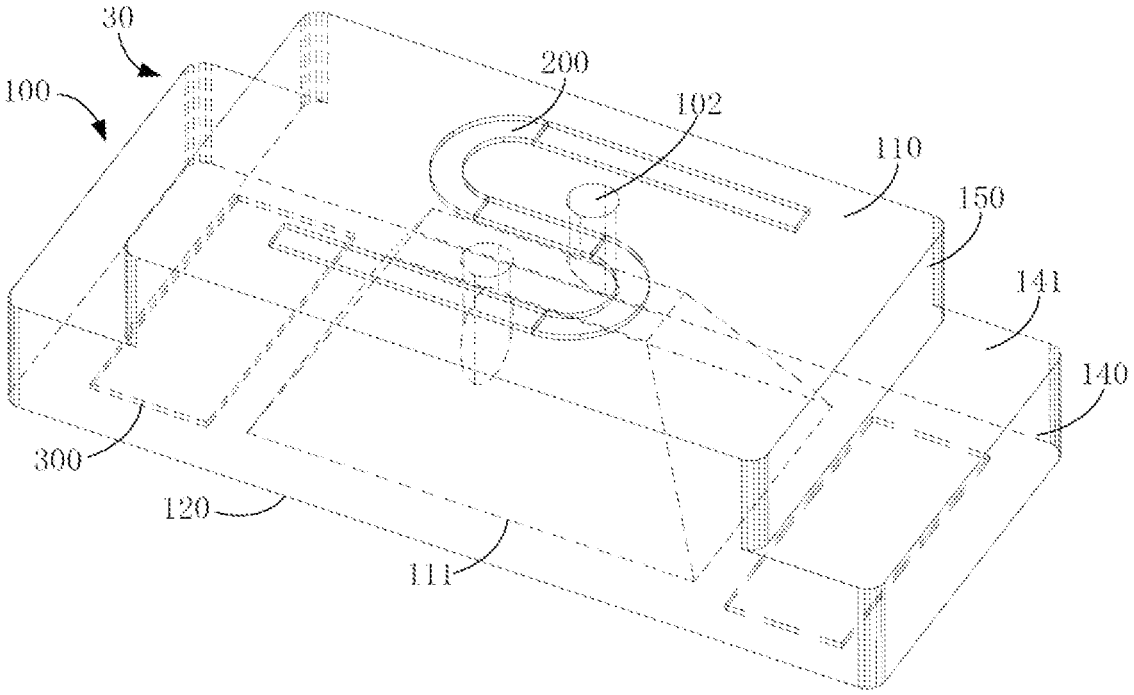
FIG. 9 is a schematic three-dimensional structural diagram of a fourth example vaporization core of the vaporizer shown in FIG. 1.
Figure 10:
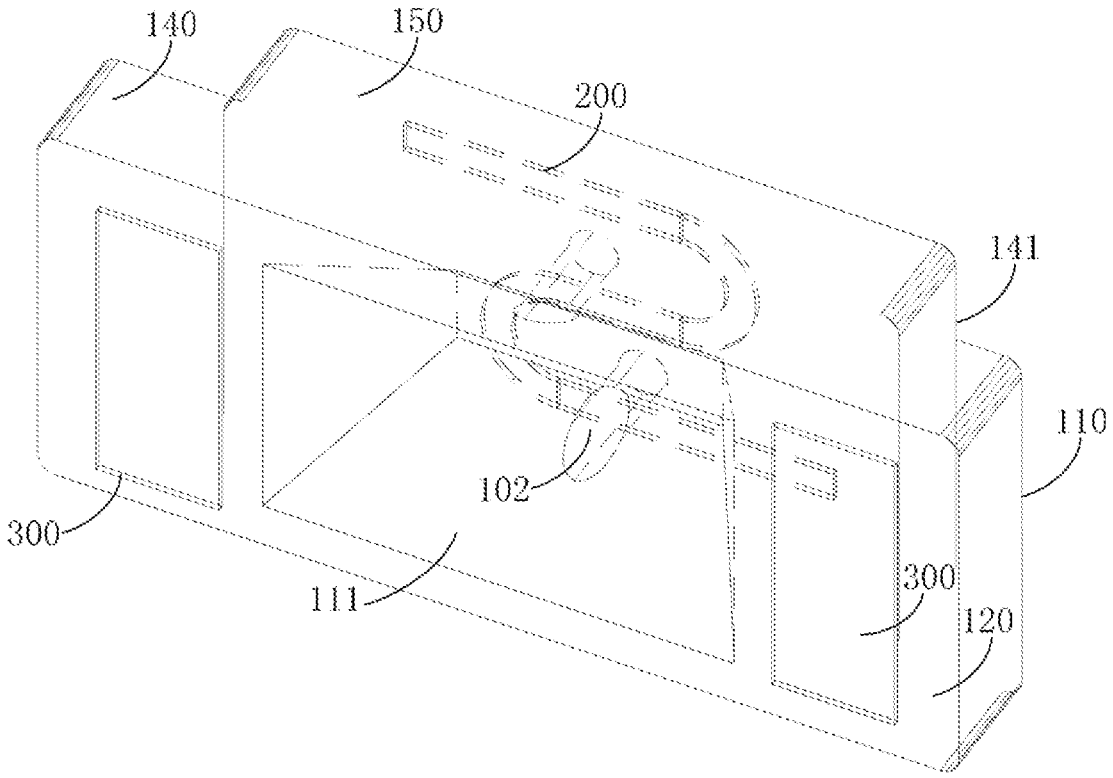
FIG. 10 is a schematic three-dimensional structural diagram of the vaporizer shown in FIG. 9 from another perspective.

Referring to FIG. 9 and FIG. 10 together, the substrate 100 may further include a base portion 140 and a boss portion 150. The base portion 140 has a step surface 141, and the mounting surface 120 is located on the base portion 140. The mounting surface 120 and the step surface 141 are oriented in opposite directions, that is, the step surface 141 is arranged facing upward and the mounting surface 120 is arranged facing downward.

The boss portion 150 is connected to the step surface 141, and the boss portion 150 protrudes from the step surface 141 by a certain height. The heating surface 110 is located on the boss portion 150, so that the heating surface 110 is arranged upward. When the substrate 100 is mounted on the suction nozzle 20, the step surface 141 and the boss portion 150 can provide a good limiting function for the whole substrate 100, thereby improving the stability and reliability of the mounting of the vaporization core 30.

In some embodiments, the vaporizer 10 and the power supply are detachably connected. When the vaporizer 10 is a disposable consumable, the used vaporizer 10 can be conveniently unloaded from the power supply and discarded separately, and the power supply may be used with a new vaporizer 10 to realize recycling.

The technical features of the above embodiments can be arbitrarily combined. In order to make the description concise, all possible combinations of the technical features in the above embodiments are not described. However, as long as no contradiction exists in the combinations of these technical features, the technical features should be considered as the scope of this specification.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporization core of an electronic vaporization device, comprising:

a heating body configured to generate heat;

an electrode body electrically connected to the heating body; and a substrate configured to buffer liquid and having a mounting surface and a heating surface spaced apart from the mounting surface, wherein the electrode body is arranged on the mounting surface, wherein the heating body is arranged on the heating surface, wherein the heating surface is configured to absorb heat generated by the heating body and vaporize the liquid, and wherein the electrode body comprises a sheet structure mounted directly to the mounting surface such that a largest face of the electrode body extends along the mounting surface and faces away from the substrate.

2. The vaporization core of claim 1, wherein the mounting surface and the heating surface are oriented in opposite directions.

3. The vaporization core of claim 1, further comprising:

a connecting body, wherein a through hole extending through both the mounting surface and the heating surface is formed in the substrate, wherein the connecting body extends through the through hole, wherein one end of the connecting body is electrically connected to the heating body, and wherein an other end of the connecting body is electrically connected to the electrode body.

4. The vaporization core of claim 3, wherein the substrate further comprises a liquid absorbing surface configured to absorb liquid, wherein the liquid absorbing surface is connected between the mounting surface and the heating surface, and wherein a spacing between the connecting body and the liquid absorbing surface is less than a spacing between the connecting body and a geometric center of the substrate.

5. The vaporization core of claim 3, wherein the connecting body and the heating body comprise a same material.

6. The vaporization core of claim 2, wherein an air guide hole is further formed on the substrate, and wherein the air guide hole extends through both the mounting surface and the heating surface.

7. The vaporization core of claim 6, wherein a caliber of the air guide hole ranges from 0.05 mm to 5.00 mm.

8. The vaporization core of claim 2, wherein a groove recessed toward the heating surface by a set depth is formed on the mounting surface.

9. The vaporization core of claim 2, wherein the substrate comprises a base portion and a boss portion, wherein the base portion is provided with a step surface, the mounting surface is located on the base portion and opposite the step surface, the boss portion is connected to the step surface and protrudes from the step surface, and the heating surface is located on the boss portion.

10. The vaporization core of claim 2, wherein the mounting surface and the heating surface are parallel planes.

11. The vaporization core of claim 1, wherein a groove is recessed into the mounting surface and the electrode body is embedded in the groove such that the largest face of the electrode body is flush with the mounting surface.

12. The vaporization core of claim 1, wherein the heating body comprises a strip-shaped sheet structure, a thickness of the heating body ranges from 0.01 mm to 2.00 mm, and a width of the heating body ranges from 0.05 mm to 3 mm.

13. The vaporization core of claim 1, wherein the substrate comprises a porous ceramic body, and the heating body comprising a metal heating body or an alloy heating body.

14. The vaporization core of claim 1, wherein the heating body is directly attached to the heating surface, or a groove is recessed into the heating surface, and the heating body is embedded in the groove.

15. The vaporization core of claim 1, wherein the substrate and the heating body are integrally formed.

16. A vaporizer, comprising:

a suction nozzle; and the vaporization core of claim 1, wherein an airflow channel is formed in the suction nozzle, wherein the vaporization core is located in the airflow channel, wherein the airflow channel extends through a surface of the suction nozzle to form a suction nozzle opening for inhaling smoke, wherein the heating surface is arranged facing the suction nozzle opening, and wherein the mounting surface is arranged facing away from the suction nozzle opening.

17. An electronic vaporization device, comprising:

a power supply; and the vaporizer of claim 16, wherein the power supply comprises a conductor configured to be electrically connected to the electrode body, and wherein the conductor is located on a side where the mounting surface is located.

18. The electronic vaporization device of claim 17, wherein the vaporizer is detachably connected to the power supply.

19. The vaporization core of claim 4, wherein the liquid absorbing surface corresponds to an outermost periphery of the substrate and faces a lateral direction perpendicular to the mounting surface and/or the heating surface.

20. The vaporization core of claim 1, wherein the electrode body extends inward along the mounting surface relative to an outer periphery of the mounting surface.

* * * * *